United States Patent [19]

Grüger et al.

[11] 4,425,110

[45] Jan. 10, 1984

[54] DRIVE ARRANGEMENT FOR A FOLDING DEVICE

[75] Inventors: Christian Grüger, Bennewitz; Reinhold Freistedt, Rückmarsdorf; Richard Thiele, Eythra, all of German Democratic Rep.

[73] Assignee: VEB Polygraph Leipzig, Kombinat für Polygraphische Maschinen und Ausrüstungen, Leipzig, German Democratic Rep.

[21] Appl. No.: 157,633

[22] Filed: Jun. 6, 1980

Related U.S. Application Data

[63] Continuation-in-part of Ser. No. 48,356, Jun. 14, 1979, abandoned.

[30] Foreign Application Priority Data

Jun. 22, 1978 [DD] German Democratic Rep. ... 206201

[51] Int. Cl.[3] ..... B65H 45/18

[52] U.S. Cl. ..... 493/444; 493/457; 74/110

[58] Field of Search ..... 493/442–445, 493/448–451, 457; 74/520, 110

[56] References Cited

U.S. PATENT DOCUMENTS

| | | | |
|---|---|---|---|
| 3,117,777 | 1/1964 | Funk | 493/444 |
| 3,892,138 | 7/1975 | Vomberg | 74/520 X |
| 3,995,850 | 12/1976 | Hertrich | 493/444 |

FOREIGN PATENT DOCUMENTS

| | | | |
|---|---|---|---|
| 485067 | 7/1952 | Canada | 493/444 |

OTHER PUBLICATIONS

Strasser, "10 Ways to Change Straight Line Direction", Product Engineering, Feb. 29, 1960, pp. 61–63.

Strasser, "9 More Ways to Change Straight Line Direction", Product Engineering, Mar. 7, 1960, pp. 59–61.

*Primary Examiner*—A. J. Heinz

*Attorney, Agent, or Firm*—Michael J. Striker

[57] ABSTRACT

A drive arrangement for folding blades in sheet-processing machines with a pair of folding rollers to support the sheet material to be folded and a folding blade movable in the direction toward the sheet material includes a linear motor with a secondary part movable along the stationary part of the motor. A transmission device coupled with the secondary part of the motor and connected to the folding blade is provided to effect the reciprocating movement of the folding blade to and from the material to be folded.

7 Claims, 6 Drawing Figures

DRIVE ARRANGEMENT FOR A FOLDING DEVICE

CROSS-REFERENCE TO RELATED APPLICATION

This application is a continuation-in-part of our copending application Ser. No. 48,356 filed June 14, 1979 and entitled "Drive system for folding blades for the folding flat material" and now abandoned.

BACKGROUND OF THE INVENTION

FIELD OF INVENTION

The invention relates to a folding device utilized for folding of flat material, preferably paper, including folding blades arranged for reciprocating movement in the direction perpendicular to a material to be folded.

More particularly, the invention relates to a drive system for folding blades in sheet-processing machines which have at least one blade-folding mechanism, with one pair of folding rollers arranged parallel to each other and driven in opposite-rotating directions and provided with a folding blade movable in the direction of the roller gap between the rollers.

It is known from the FRG Allowed Application 1,611,344 that the reciprocating movement of the folding blades into and out of contact with a material being folded may be caused by compressed air. It is furthermore known how to actuate folding blades by magnets. These drive systems have the disadvantage that they work relatively slowly and cannot fulfill the demands for output at high working working cycles. They also do not allow materializing of predetermined functions of power transmission as a basis for appropriate folding methods.

Furthermore, counter-controlled folding blade drives are known, wherein clutches with electrical, mechanical, or pneumatic actuation are interposed. These solutions have the disadvantage that the continual sequences of momentary starting and braking will cause heating-up and wear of the parts of the drive arrangement. In this case, changes of mechanical and electrical parameters will occur during operation, and will, on their part, influence the folding sequence.

SUMMARY OF THE INVENTION

It is an object of the invention to provide an improved drive arrangement in a folding device.

Still another object of the invention, is to provide an efficient drive arrangement with sufficiently reduced wear of the driving elements.

These and other objects of the invention are attained by a drive arrangement for a folding device which comprises a frame, a pair of rotatable folding rollers which are positioned beneath a sheet material to be folded to support this material and spaced one from another to define a gap therebetween, and a folding blade. The drive arrangement is provided with a linear motor including a first stationary part and a secondary part which is arranged to be periodically movable in two opposite directions relative to the first stationary part by a motive force generated upon energization of the linear motor. The drive arrangement also includes transmission means coupled with the secondary part of the motor and connected to the folding blade to provide a reciprocating movement of the blade into and out of contact with the material being folded in the area of the gap between the rollers.

The transmission means of the arrangement in accordance with the invention may include a first coupling rod linked to the secondary part of the linear motor, a crank pivotally supported on the frame of the device and a second coupling rod disposed between the crank and the folding blade.

The transmission means may also be formed as a combination of a first link connected to the secondary part of the linear motor, a coupling rod coupled to the first link and a second link positioned between the coupling rod and the folding blade.

The transmission means according to the invention may be modified so as to include a cam element connected to the secondary part ad a contact roller mounted on the frame and arranged in contact with the cam element which is concavely curved to define two terminal positions of the contact roller. The transmission means also include a ram element coupled to the contact rollers with one end thereof and to the folding blade with another end thereof. The contact roller may be biased by a compression spring.

The linear motor may be positioned coaxially with the direction of reciprocating movement of the folding blade. In this case the folding blade may be immediately coupled with the secondary part of the linear motor.

The construction of the invention may be provided with shock-absorbing means for cushioning the shock of the secondary part during the movement of the latter.

The arrangement of the invention may also comprise stop means to support a sheet material being folded in a requisite position against the folding blade and signal means operatively connected to the stop means and to the secondary part to permit the movement of the folding blade into contact with the sheet material when the latter is in its requisite position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
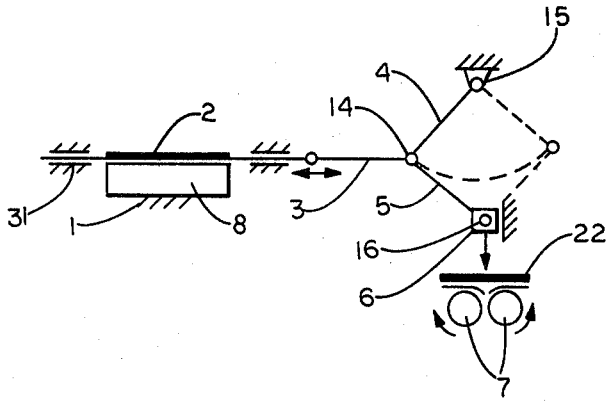
FIG. 1 is a schematic view of the drive arrangement showing a first embodiment of the invention.

In accordance with the invention a drive arrangement for a folding device illustrated in FIGS. 1–6 includes a linear motor 8 including a first stationary part 1 and a secondary part 2 which is movable along the length of the stationary part 1 in the guide rails 31. The linear motor utilized in the invention is of conventional structure and normally comprises a stator and an armature mounted for travel along the length of the stator. The armature carries a plurality of coils intersecting the magnetic-field lines of the magnet system. The armature travels along the length of the stator by a motive force generated by the current flowing through the coils and cooperating with magnetic flux of the magnetic system. To cause the armature travel the coils are energized by a conventional commutating system. The first stationary part 1 of the linear motor is a stator portion of the motor and the secondary part 2 is a movable armature of the motor, or the secondary part 2 may be formed as a separate element rigidly connected to the armature of the motor for reciprocating movement thereof upon energization of the motor.

The linear motor 8 is provided in a sheet-folding machine as a drive unit for a folding blade 6. The linear motor is operatively connected to the supporting arrangements in a manner which will be described below so that every time a sheet is ready for folding, the linear motor will be actuated by an impulse. A sheet of metal or any other material 22 is fed onto a pair of parallel folding rollers 7 rotated in opposite directions and spaced one from another to define a gap therebetween. Rollers 7 serve to support the sheet of metal to be folded during operation. The examples shown in FIGS. 1 to 4 illustrate various modifications of the linkages arranged after the linear motor 8 to enable a defined stroke of the folding blade 6. These linkages include transmission elements provided between the secondary part 2 and the folding blade 6 to actuate the latter.

The linear motor 8 acts, as per FIG. 1 by the secondary part 2 movably located within stationary guide rails and coupled to a coupling rod 3. A crank 4 and a coupling rod 5 of a toggle drive are linked at a joint to a frame designated as 15. The coupling rod 5 is in turn connected with the second end to a joint 16 of the folding blade 6. With every stroke of the secondary part 2, the folding blade 6 is pressed in a downward direction, and the sheet 22 to be folded is pressed in a gap between the folding rollers 7, whereupon the folding blade 6 again returns to its starting position.

On moving the secondary part 2 of the linear motor in the direction of action, the coupling rod 3 and the crank 4 are moved in such a manner that the folding blade 6 will go through a folding cycle. The folding cycle is defined between two reversing positions of the crank symmetrical to the extended position of the transmission linkage as shown in FIG. 1. An adjustment of the depth of the stroke of the folding blades between the folding rollers may be made, with the greatest depth of the stroke being attained in the extended position of the coupling rod 3 and the crank 4.

Figure 2:
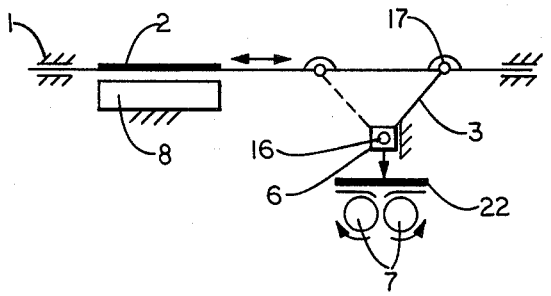
FIG. 2 is a schematic view of the drive arrangement illustrating a second embodiment of the invention.

FIG. 2 shows a transmission arrangement between the secondary part 2 and the folding blade 6 including a double slide arranged after the linear motor 8. Here, the coupling rod 3 is linked at the joint 16 of the blade 6 to a link 17 connected to the secondary part 2. When a sheet to be folded is ready, the secondary part 2, and associated thereto the link 17 move in a straight line shown by arrows in FIG. 2 from one reversing position to another reversing position, in such a way that the folding sequence ensues through the coupling rod 3, shown by sold end dotted lines in two reversing position.

Figure 3:
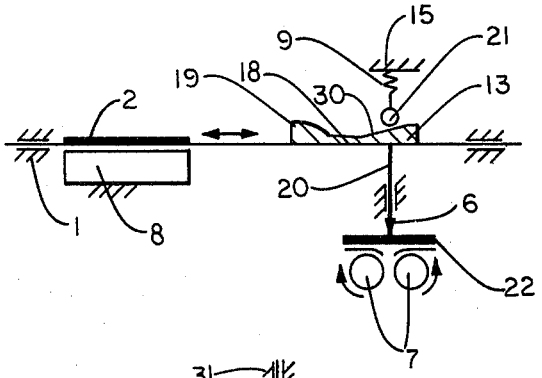
FIG. 3 is a schematic view of the drive arrangement showing a third embodiment of the invention.

FIG. 3 shows an arrangement in which a cam element 13 with a concavely curved upper surface 30 is fixed to the secondary part 2 of the linear motor 8. The cam element 13 is arranged in such a manner, that the two raised ends 19 are spaced from a low point 18. The folding blade 6 is connected by a ram 20 to a contact roller 21 which is held by a spring 9 against the curved surface of cam element 13 in such a manner that power can be transmitted by friction. Folding ensues when the contact roller 21 is at the low point 18. On actuation of the linear motor, the secondary part 2 with the cam element 13 will move to one side, whereby the contact roller 21 will reach its low point and the sheet to be folded is transferred to the folding rollers 7 on reaching of this lowest point. On continued sliding of the secondary part, the folding blade will reach its starting position for the next folding sequence.

Figure 4:
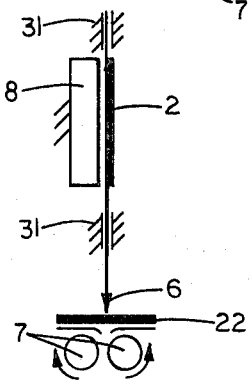
FIG. 4 is a schematic view of the drive arrangement illustrating still another embodiment of the invention.

FIG. 4 shows still another modification of the transmission arrangement between the secondary part and the folding blade. The secondary part 2 is connected directly with the link point of the folding blade 6 and will thus directly cause the folding blade 6 to move with the folding sheet 22 between the folding rollers 7, thus also initiating the folding sequence. In this case the axis of elongation of the linear motor is aligned with the axis of the reciprocating movement of the folding blade 6. It is therefore understood that in each modification, the forward and reverse stroke of the secondary part of the linear motor are used for the folding action.

Figure 5:
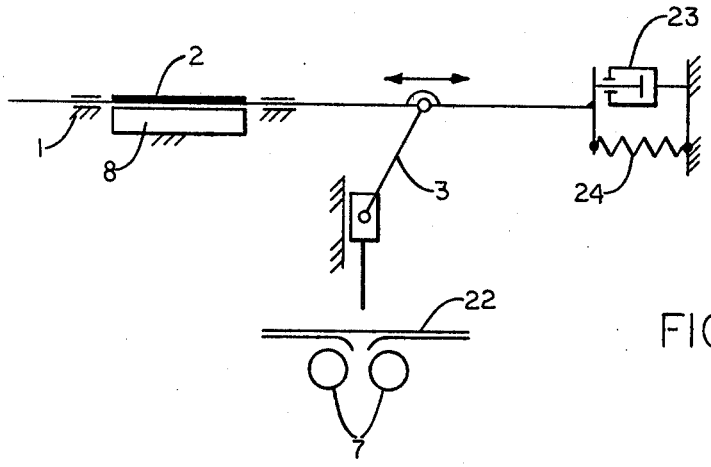
FIG. 5 illustrates a schematic view of a shock-absorbing arrangement provided in the drive device of the invention.

FIG. 5 illustrates the drive arrangement of the invention, wherein the secondary part 2 is provided with a shock-absorbing structure to absorb the kinetic energy of this secondary part. The shock absorber may include a damper arrangement 23 and a spring 24 which is compressed upon the movement of the secondary part 2 to the right. The kinetic energy of the secondary part 2, the coupling rod 3 and the folding blade 6 must be eliminated at the terminal reversal points of these movable elements. This is achieved by a damper arrangement 23 which absorbs the shock of the secondary part 2 in the event the latter travels so far along the length of the stationary part as to impact against the walls of the device. The kinetic energy may be accumulated in the damper 23 and may be used for a successive operation cycle when the spring 24 is expanded to accelerate the movement of the secondary part in the reversal direction.

Figure 6:
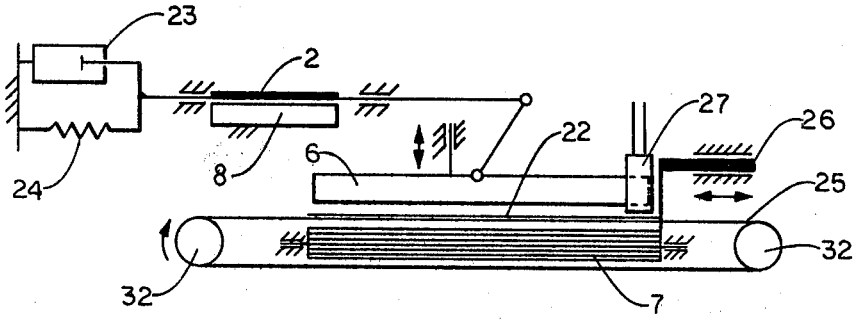
FIG. 6 illustrates a schematic view of the drive arrangement of the invention with stop means and signal means provided therein.

FIG. 6 shows the drive arrangement of the invention wherein a control arrangement to sense the position of the sheet to be folded is illustrated. The control arrangement includes a signal device or pickup element 27 mounted on the folding blade 6 and electrically connected to the linear motor 8. A stop element 26 is arranged above the folding rollers 7 which is connected to a feeding mechanism (not shown) for feeding and positioning each successive sheet being folded on the folding rollers 7. A pair of bands 25 are provided which surround rotatable rollers 32 and support a sheet of material to be treated. The position of the each sheet is sensed by the signal element 27 and in case of the proper position of the sheet material, this element 27 transmits the signal to the corresponding part of the linear motor so that each next sheet will initiate, by an appropriate impulse, the reverse movement of the secondary part 2 and thus and next folding sequence. The movement of the folding blade 6 in a downward direction is therefore warranted by the appropriate signal from the pickup element 27. The pickup 27 may be adjusted in accordance with inertia of the electrical and mechanical parts of the drive arrangement in dependence upon the form and velocity of the sheet material to be folded.

It will be understood that each of the elements described above, or two or more together, may also find a useful application in other types of drive arrangement differing from the types described above.

While the invention has been illustrated and described as embodied in a drive arrangement it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a drive arrangement for a folding device, a combination comprising a frame, a pair of rotatable parallel folding rollers, said rollers being positioned beneath a sheet material to be folded to support the latter and spaced one from another to define a gap therebetween; at least one folding blade; a linear electric motor including a primary stationary part and a secondary part, said secondary part being periodically movable in two opposite directions relative to said primary part by a motive force generated upon energization of said linear electric motor; and transmission means coupled immediately with said secondary part and connected to said folding blade so that said transmission means are moved by said secondary part to provide a reciprocating movement of said blade into and out of contact with the sheet material to push the material into said gap, said transmission means include a cam element connected to said secondary part, a contact roller mounted on said frame and arranged in contact with said cam element, said cam element being concavely curved, and a ram element having one end and another end and coupled to said contact roller with one end thereof and to said folding blade with another end thereof.

2. The drive arrangement of claim 1, further including a compression spring connected to said contact roller to bias the same.

3. The drive arrangement of claim 1, wherein said linear motor is positioned so that its axis of elongation coincides with the direction of movement of said folding blade, said folding blade being coupled with said second part of said linear motor.

4. The drive arrangement of claim 1, further comprising shock-absorbing means for cushioning the shock of said secondary part during the periodical movement thereof to thereby prevent impacts of said second part against said frame which may occur during operation.

5. The drive arrangement of claim 1, further comprising stop means to stop said sheet material upon reaching thereof a requisite position.

6. The drive arrangement of claim 5, further comprising control means mounted on said folding blade, said control means being operatively connected to said secondary part and to said stop means to permit said movement of said folding blade into contact with the sheet material when the material being folded is in a requisite position.

7. The drive arrangement of claim 1, wherein said primary stationary part is a stator of said motor and said secondary part is a movable armature of the motor.

* * * * *